US006648048B2

(12) United States Patent
Lai

(10) Patent No.: US 6,648,048 B2
(45) Date of Patent: Nov. 18, 2003

(54) WINDOW BLINDING SYSTEM WITH MULTIPLE SHADING EFFECTS

(76) Inventor: Tony Lai, 2328 N. Durfee Ave., #A, El Monte, CA (US) 91732

( * ) Notice: Subject to any disclaimer, the term of this patent is extended or adjusted under 35 U.S.C. 154(b) by 0 days.

(21) Appl. No.: 10/038,447

(22) Filed: Jan. 7, 2002

(65) Prior Publication Data

US 2003/0127197 A1 Jul. 10, 2003

(51) Int. Cl.[7] ..... E06B 3/48

(52) U.S. Cl. ..... 160/115; 160/113; 160/168.1 R; 160/176.1 R

(58) Field of Search ..... 160/113, 115, 160/84.01, 84.07, 167, 168 R, 176 R, 178 R, 178.3 R, 236

(56) References Cited

U.S. PATENT DOCUMENTS

| | | | | | |
|---|---|---|---|---|---|
| 2,117,953 | A | * | 5/1938 | Grau | 160/115 |
| 2,318,525 | A | * | 5/1943 | Renton | 160/115 |
| 2,459,517 | A | * | 1/1949 | Gearhart | 160/115 |
| 2,673,607 | A | * | 3/1954 | Rulfs | 160/115 |
| 2,836,237 | A | * | 5/1958 | Hogin et al. | 160/115 |
| 2,839,136 | A | * | 6/1958 | Reichel | 160/115 |
| 4,245,435 | A | * | 1/1981 | Ulbricht | 49/64 |
| 4,593,738 | A | * | 6/1986 | Chi Yu | 160/176 R |
| 4,699,196 | A | * | 10/1987 | Elliot | 160/168 R |
| 4,813,468 | A | * | 3/1989 | Fraser | 160/84.1 |
| 4,953,610 | A | * | 9/1990 | Phillips et al. | 160/84.1 |
| 5,009,258 | A | * | 4/1991 | Fraser | 160/168.1 |
| 5,090,466 | A | * | 2/1992 | Hong | 160/84.1 |
| 5,121,783 | A | * | 6/1992 | Nilsson | 160/89 |
| 5,918,657 | A | * | 7/1999 | Tuzmen | 160/168.1 R |
| 6,318,439 | B1 | * | 11/2001 | Matsubara | 160/115 |

FOREIGN PATENT DOCUMENTS

| | | | | |
|---|---|---|---|---|
| WO | WO 92/10636 | * | 6/1992 | 182/115 |

* cited by examiner

*Primary Examiner*—Bruce A. Lev
(74) *Attorney, Agent, or Firm*—Raymond Y. Chan; David and Raymond Patent Group

(57) ABSTRACT

A window blinding system includes a top traverse supporter adapted for affixing to a top beam of a ceiling, a first shading arrangement, and a second shading arrangement. The first shading arrangement includes a first base member, a plurality of first slats, a first blind supporting system for spacedly and suspendedly supporting the first slats horizontally between the top traverse supporter and the first base member, and a first operating system for selectively lifting up and dropping down the first base member towards and from the top traverse supporter. The second shading arrangement includes a plurality of second slats and a second blind supporting system for spacedly and suspendedly supporting the second slats horizontally between the first slats. Therefore, by selectively adjusting positions of the first and second slats, the first and second shading arrangements are capable of providing multiple shading effects.

7 Claims, 12 Drawing Sheets

WINDOW BLINDING SYSTEM WITH MULTIPLE SHADING EFFECTS

BACKGROUND OF THE PRESENT INVENTION

1. Field of Invention

The present invention relates to window blind, and more particularly to a window blinding system which is adapted for providing multiple shading effects.

2. Description of Related Arts

Blind and the like such as drapes and portieres are common used for sheltering window, separating spaces, and etc., since they are easy to open and close and aesthetically appealing. Most of the blind comprise a traverse supporter adapted to be affixed to a ceiling, a slider track mounted on a bottom of the traverse supporter, and a plurality of blades horizontally and suspendedly mounted by hanging strings respectively in such a manner that, by operating a pulley system, the blades are slid in a vertical movable manner, or individually rotated at the same time.

However, the blind has several drawbacks. When the blind is opened, sunlight can directly enter the house that not only can heat up the interior of the house but also is unpleasing to people's eye. On the other hand, when the blind is fully closed, it blocks all the sunlight effectively. Then, people may alternatively need to turn on the light lamp in order to brighten up the house. Furthermore, people has no privacy at all because the interior of the house is easily viewed from outside when the blind is opened, so that people may merely close the blind for privacy and security or open the blind for enjoying the sunlight.

Besides, when the blind is fully opened, the sunlight is allowed to enter the house through a blade gap between two blades. However, the size of the blade gap is predetermined by the manufacturer such that the user may have no other alternation. In order to allow more sunlight passing through the blind, the blade gap must be increased intentionally such that the width of the blade must be increased correspondingly for covering up the blade gap when closing the blind. However, the user will not have privacy at all. Therefore, the user always has a conflict between opening and closing the blind for allowing sunlight passing therethrough and for privacy purpose respectively.

Moreover, the major drawback of the blind is that the blind provides limited operations for obtaining limited shading effects. In other words, the user can only control the opening and closing operations of the blind and the rotation of the blades at the same time. So, no conventional blind can provide partially open and partially close position of the blades for the user to select.

SUMMARY OF THE PRESENT INVENTION

A main object of the present invention is to provide a window blinding system which can provides multiple shading effects.

Another object of the present invention is to provide a window blinding system, which comprises at least two operating systems for individually controlling two sets of slats so as to selectively shade the intensity of sunlight. Moreover, the two operating systems are operating individually so as to prevent the two sets of slats from being interfered with each other.

Another object of the present invention is to provide a window blinding system, wherein a section of the set of the slats can be individually operated such that the window blinding system is capable of partially opening and partially closing so as to selectively allow the sunlight passing through the opening section only.

Another object of the present invention is to provide a window blinding system which can achieve all features of conventional blind such as easy operation, less expensive, adapted to soften the sunlight, keep personal privacy, and providing an aesthetically appealing. In other words, the present invention is an all-in-one window blinding system.

Another object of the present invention is to provide a window blinding system, wherein no expensive and complicated structure is employed in the present invention in order to achieve the above mentioned objects. Therefore, the present invention successfully provides an economic and efficient solution for providing multiple shading effects.

Accordingly, in order to accomplish the above objects, the present invention provides a window blinding system, which comprises a top traverse supporter adapted for affixing to a top beam of a ceiling, a first shading arrangement, and a second shading arrangement.

The first shading arrangement, which is downwardly extended from the top traverse supporter, comprises a first base member, a plurality of first slats, a first blind supporting system for spacedly and suspendedly supporting the first slats horizontally between the top traverse supporter and the first base member and controlling a tilt angle of each of the first slats, and a first operating system for selectively lifting up the first base member towards the top traverse supporter and unlifting the first base member to drop downwardly away from the top traverse supporter.

The second shading arrangement comprises a plurality of second slats, a second blind supporting system for spacedly and suspendedly supporting the second slats horizontally between the top traverse supporter and the second base member and controlling a tilt angle of each of the second slats, and a second operation system for selectively lifting up the second base member towards the top traverse supporter and unlifting the second base member to drop downwardly away from the top traverse supporter.

Therefore, by selectively adjusting positions of the first and second slats of the first and second shading arrangements, the first and second shading arrangements are capable of blocking a light passing through from one side to another side of the window blinding system so as to provide multiple shading effects.

DETAILED DESCRIPTION OF THE PREFERRED EMBODIMENT

Figure 1:
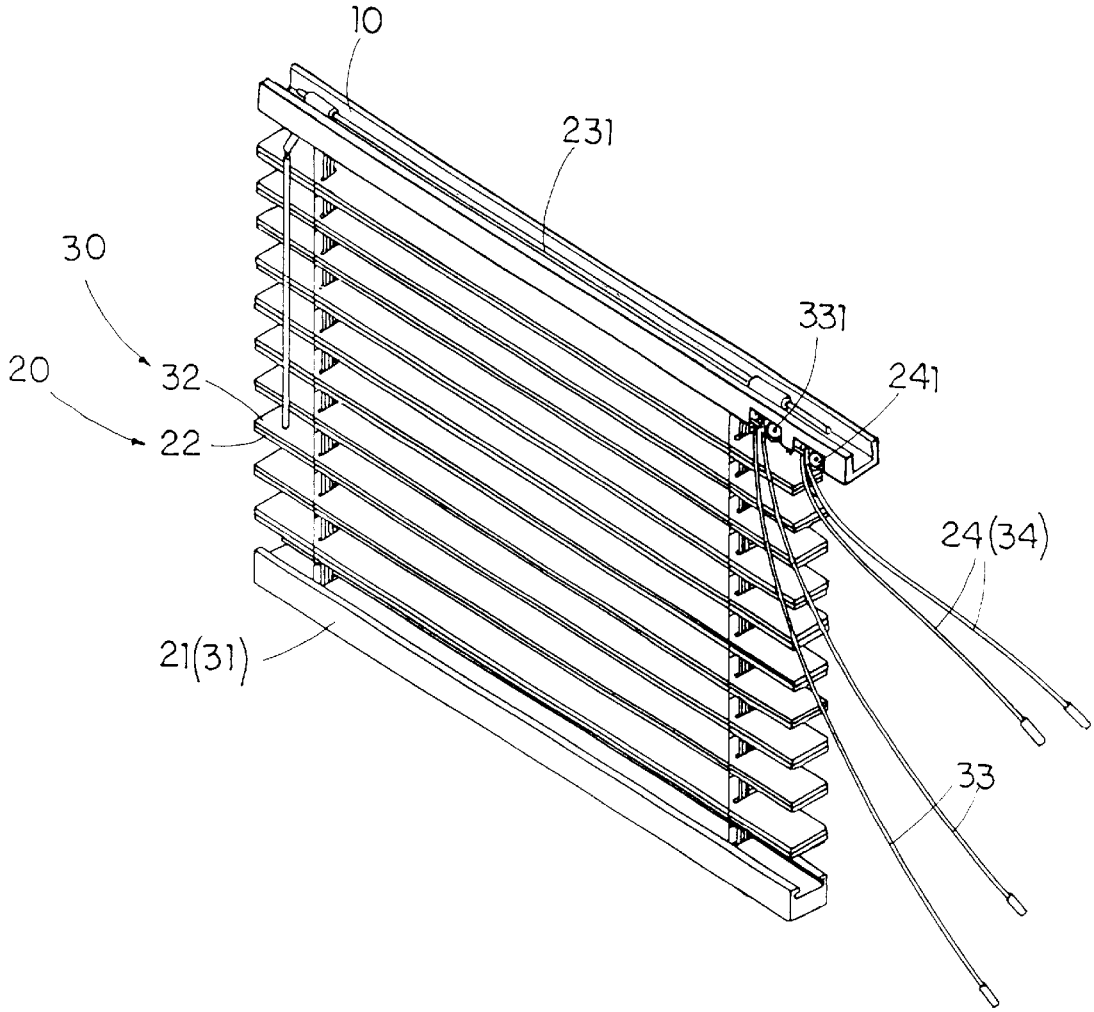
FIG. 1 is a perspective view of a window blinding system according to a first preferred embodiment of the present invention.
Figure 2:
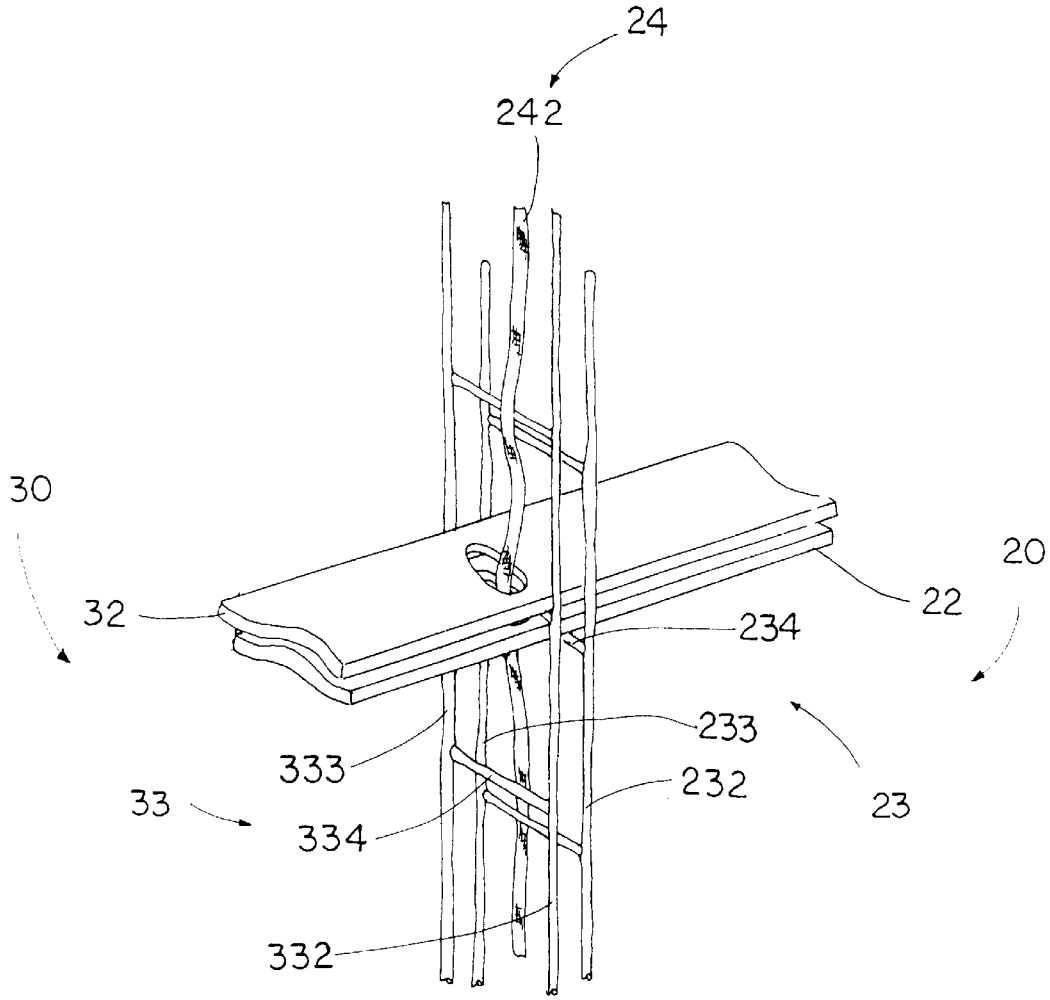
FIG. 2 is a partially perspective view of the window blinding system according to the above first preferred embodiment of the present invention.

Referring to FIGS. 1 and 2 of the drawings, a window blinding system according to a first preferred embodiment of the present invention is illustrate, wherein the window blinding system comprises a top traverse supporter 10 adapted for affixing to a top beam of a ceiling, a first shading arrangement 20, and a second shading arrangement 30 wherein the first and second arrangements 20, 30 are capable of selectively blocking a light passing through from one side to another side of the window blinding system so as to provide multiple shading effects.

The first shading arrangement 20, which is downwardly extended from the top traverse supporter 10, comprises a first base member 21, a plurality of first slats 22, a first blind supporting system 23 for spacedly and suspendedly supporting the first slats 22 horizontally between the top traverse supporter 10 and the first base member 21 and controlling a tilt angle of each of the first slats 22, and a first operating system 24 for selectively lifting up the first base member 21 towards the top traverse supporter 10 and unlifting the first base member 21 to drop downwardly away from the top traverse supporter 10.

The second shading arrangement 30 comprises a second base member 31, a plurality of second slats 32, a second blind supporting system 33 for spacedly and suspendedly supporting the second slats 32 horizontally between the top traverse supporter 10 and the second base member 31 and controlling a tilt angle of each of the second slats 32, and a second operation system 33 for selectively lifting up the second base member 31 towards the top traverse supporter 10 and unlifting the second base member 31 to drop downwardly away from the top traverse supporter 10.

The first blind supporting system 23 comprises a traverse arm 231 rotatably mounted on the top traverse supporter 10, two pairs of first and second supporting cords 232, 233 extended from two ends of the traverse arm 231 to the first bottom member 21, wherein the first slats 22 are positioned between the first and second supporting cords 232, 233, and a plurality of traverse cords 234 are spacedly extended between the first and second supporting cords 232, 233, so that the first slats 22 can be rested and supported on the traverse cords 234 respectively. Furthermore, the tilt angle of the first slats 22 can be controlled by rotating the traverse arm 231 to lift up and drop down the first and second supporting cords 232, 233 at the same time. Accordingly, the first and second supporting cords 232, 233 are preferred to be integrally formed in one-piece wherein lower ends of the first and second supporting cords 232, 233 are connected together at the first base member 21.

The first operating system 24 comprises a lift lock 241 rotatably mounted on the top traverse supporter 10 and a pair of lift cords 242 each having a first end portion extended to the first bottom member 21. Each of the two lift cords 242 upwardly extends to penetrate through the first slats 22 and then traversely extends through the top traverse supporter 10, wherein a second end portion of each of the lift cords 242 is extended out of the top traverse supporter 10 via the lift lock 241 to control the folding and unfolding of the first shading arrangement 20. Accordingly, the lift cords 242 can integrally form in one piece member wherein the first end portions of the lift cords 242 are integrally connected together along the first base member 21 so as to enhance the folding and unfolding operations of the first shading arrangement 20.

According to the preferred embodiment, the first shading arrangement 20 contains a gap level 222 defined between each two first slats 22, wherein the gap level 222 is formed by the traverse cord 234 of the first blind supporting system 23 such that a distance between each two first slats 22 is doubled a height of the gap level 222. In other words, the gap level 222 is defined at a middle of each two first slats 22 in a horizontal direction such that the first slats 22 are supported by every other traverse cords 234 respectively. Each of the second slats 32, having the same shape and size of the first slat 22, is positioned between each two first slats 22. Moreover, the second base member 31 of the first shading arrangement 30 is the first base member 21 of the first shading arrangement 20.

The second operating system 34 is the first operating system 24 wherein each of the lift cords 242 also upwardly extends to penetrate through the second slats 32 and then traversely extends through the top traverse supporter 10 in such a manner that the first operating system 24 (the second operation system 34) is adapted to selectively lift and unlift the first and second shading arrangements 20, 30 at the same time.

The second blind supporting system 33 comprises a blind lock 331 mounted on the top traverse supporter 10, two pairs of first and second supporting strings 332, 333 each having a lower end extended to the first bottom member 21(31), and a plurality of traverse braces 334 spacedly extended between the first and second supporting strings 332, 333 for the second slats 32 rested on the traverse braces 334 respectively. Each pair of the first and second supporting strings 332, 333 upwardly extends to a front and back side of the second slats 32 and then traversely extends through the top traverse supporter 10, wherein free end portions of the first and second supporting strings 332, 333 are extended out of the top traverse supporter 10 via the blind lock 331 to control the vertical displacement of the second slats 32. In other words, the first and second slats 22, 32 are positioned between the first and second supporting strings 332, 333. Accordingly, the first and second supporting strings 332, 333 can integrally formed in one piece member wherein lower ends of the first and second supporting strings 332, 333 are connected together at the first base member 21 (31).

Therefore, the tilt angle of the second slats 32 can also be controlled by the traverse cords 234 while rotating the traverse arm 231 to control the tilt angle of the first slats 22 at the same time. Besides, the second blind supporting system 33 is arranged to move the second slats 32 from a normal unlifted position to a lifted position, wherein in the unlifted position, the second slats 32 is overlappedly rest on the first slats 22 respectively, and in the lifted position, the second slats 32 are lifted up at the gap levels 22 of the first shading arrangement 20 respectively such that each second slat 32 is suspendedly positioned at a middle of each two first slats 22, so as to evenly and suspendedly supporting the first and second slats 22, 32 between the top traverse supporter 10 and the first base member 21 (31).

Figure 3B:
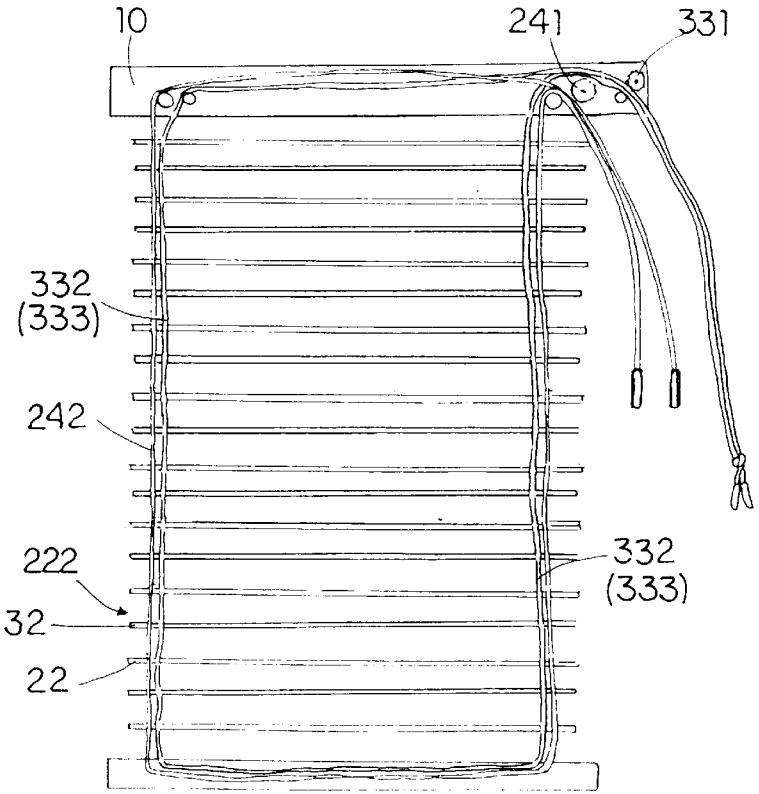
FIG. 3 is a schematic view of the window blinding system according to the above first preferred embodiment of the present invention, illustrating the operation of the window blinding system.
Figure 3A:
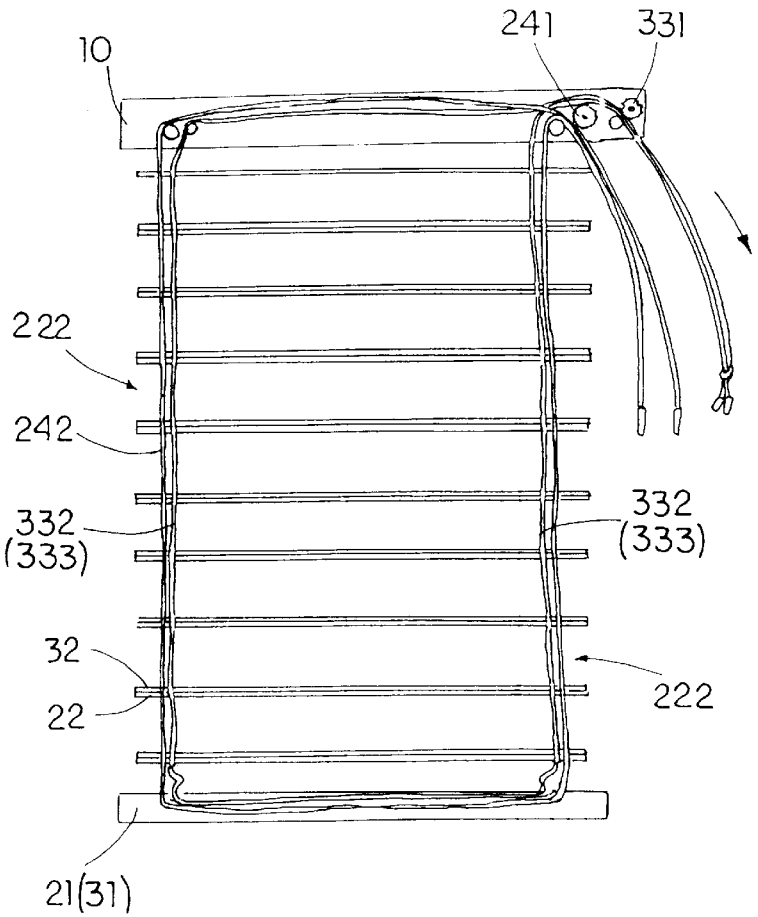

FIG. 3 illustrates an operation of the window blinding system of the present invention for providing multiple shading effects. As shown in FIGS. 2A and 3A, the second shading arrangement 30 is in the normal unlifted position, wherein the second slats 32 are overlappedly rested on the first slats 22 respectively so as to maximize a space between each two first slats 22, in such a manner that the window blinding system 1 allows a large amount of the light passing through the space between each two first slats 22. When second blind supporting system 33 of the second shading arrangement 30 is pulled to lift up the second slats 32, as shown in FIGS. 2B and 3B, the second slats 32 is lifted up at the gap level 222. The window blinding system only allows the light passing through a space between the first slat 22 and the second slat 32. Therefore, the user is able to operate the second shading arrangement 30 in order to provide different shading effects.

It is worth to mention that the arrangement of the second shading arrangement 30 of the window blinding system allows more light passing therethrough since the second slats 32 are normally rested on the first slats 22. Thus, each of the traverse braces 334 at the gap level 222 respectively, which does not support the second slat 32, will be lifted up to a bottom surface of the respective first slat 22 to block the further upward movement of the second slat 22, so as to reinforce the second slat 32 stayed at the gap level 22 of the first shading arrangement 20.

Similarly, the second shading arrangement 30 can be set to initially block the light passing through wherein the second slats 32 are normally positioned at the gap levels 222 between each two first slats 22 for blocking the light and are capable of dropping down to rest on the first slats 22 for allowing more light passing through.

Figure 4:
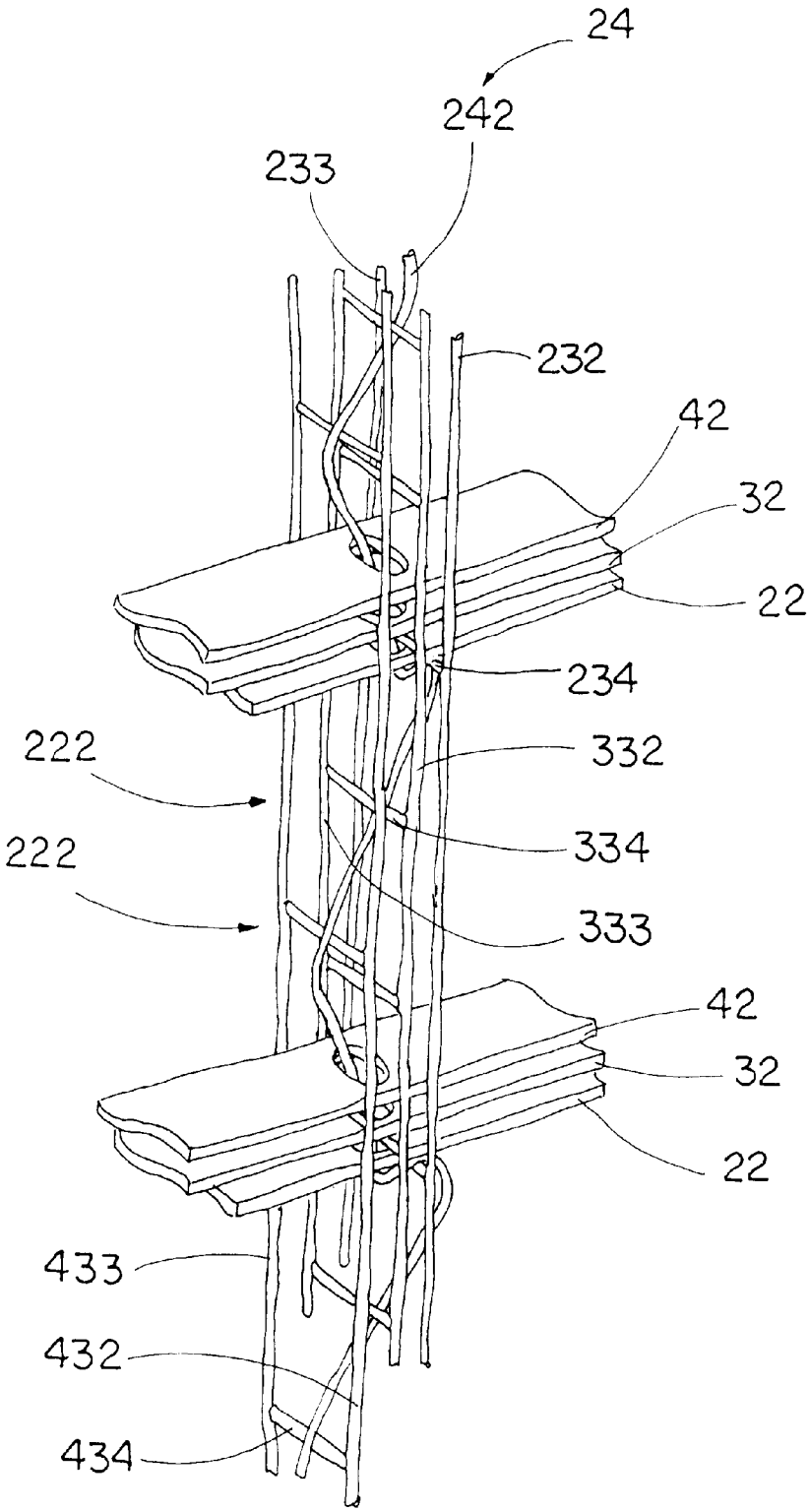
FIG. 4 illustrates an alternative mode of the window blinding system according to the above first preferred embodiment of the present invention.

FIG. 4 illustrates an alternative mode of the window blinding system, which is a further modification of the window blinding system, wherein the third shading arrangement 40A comprises a plurality of third slats 42, a third blind supporting system 43 for spacedly and suspendedly supporting the third slats 42 between the top traverse supporter 10 and the first base member 21 and controlling a tilt angle of each of the third slats 42.

Two gap levels 222 are defined between each two first slats 22 wherein a vertical distance of each gap level 222 is one-third of the distance between two first slats 22. Moreover, each of the third slats 42, having the same shaped and size of the first slat 22, is positioned between the first and second slats 22, 32.

Each of the lift cords 242 also upwardly extends to penetrate through the third slats 42 and then traversely extends through the top traverse supporter 10 in such a manner that the first operation system 24 is adapted to selectively lift and unlift the first, second, and third shading arrangements 20, 30, 40 at the same time.

The third blind supporting system 43 is arranged to move each of the second slats from a position that is overlappedly rested on the respective second slats 32 and a positions that is suspendedly supported at one of the gap levels 222 between each two first slats 22. The third blind supporting system 43 comprises a second blind lock 431, two pairs of first and second supporting ropes 432, 433 each having an lower end extended to the first bottom member 21(31), and a plurality of traverse ropes 334 spacedly extended between the first and second supporting ropes 432, 433 for the third slats 32 rested on the traverse ropes 434 respectively. Each pair of the first and second supporting ropes 432, 433 upwardly extends to a front and back side of the third slats 43 and then traversely extends through the top traverse supporter 10, wherein free end portions of the first and second supporting ropes 432, 433 are extended out of the top traverse supporter 10 via the second blind lock 431 to control the vertical displacement of the third slats 42. In other words, the first, second, and third slats 22, 32, 42 are positioned between the first and second supporting ropes 432, 433. Therefore, the tilt angle of the third slats 42 can also be controlled by the traverse cords 234 whiling rotating the traverse arm 231 to control the tilt angles of the first and second slats 22, 32 at the same time.

Figure 5C:
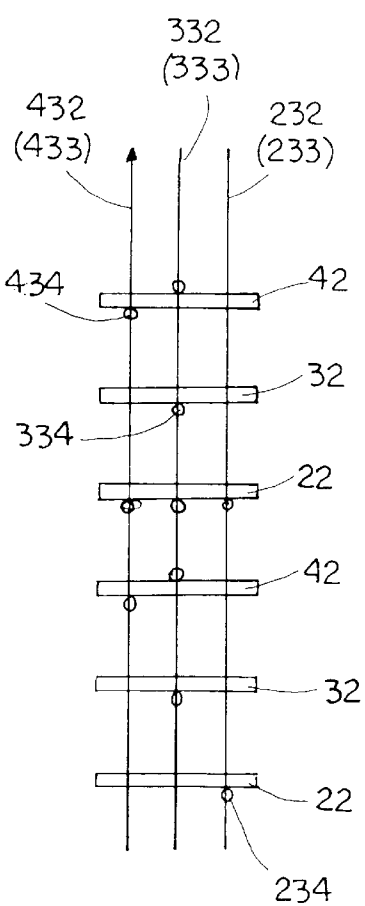
FIG. 5 is a schematic view of the window blinding system according to the alternative mode of the above first preferred embodiment of the present invention.
Figure 5B:
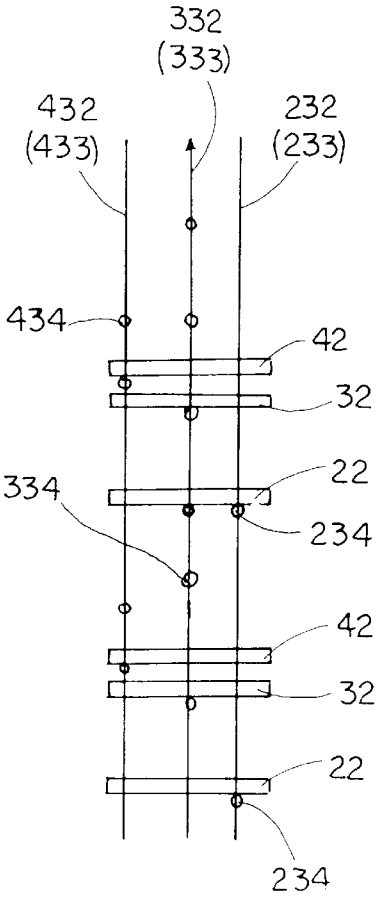
Figure 5A:
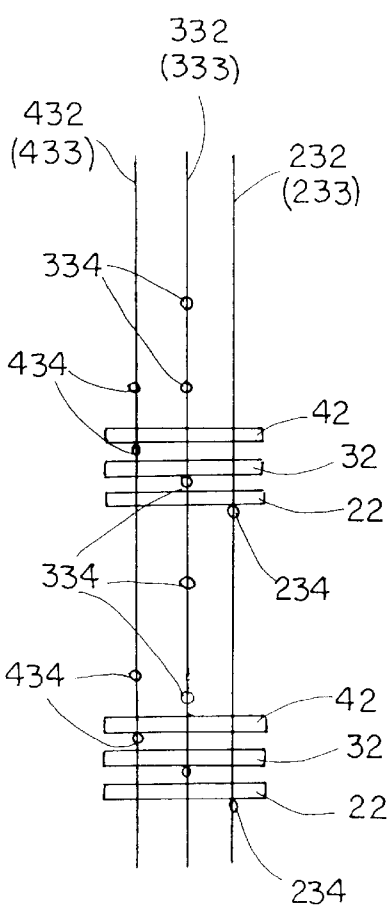

FIG. 5 illustrates the operation of the window blinding system that contains three shading arrangements 20, 30, 40 for providing multiple shading effects. As shown in FIG. 5A, the second slats 32 are overlappedly rested on the first slats 22 respectively while the third slats 42 are overlapped rested on the second slats 32 respectively, such that the window blinding system 1 allows the light passing therethrough within two gap levels 222 distance. FIG. 5B illustrates that the second slats 32 are suspendedly lifted up at the lower gap level 222 while the third slats 42 are overlappedly rested on the second slats 32 respectively. FIG. 5C illustrates that the second and third slats 32, 42 are suspendedly lifted up at the two gap levels 222 i.e. the lower and the higher gap level 222, such that the first, second, and third slats 22, 32, 42 are evenly and suspendedly supported between the top traverse supporter 10 and the first base member 21(31).

Figure 6:
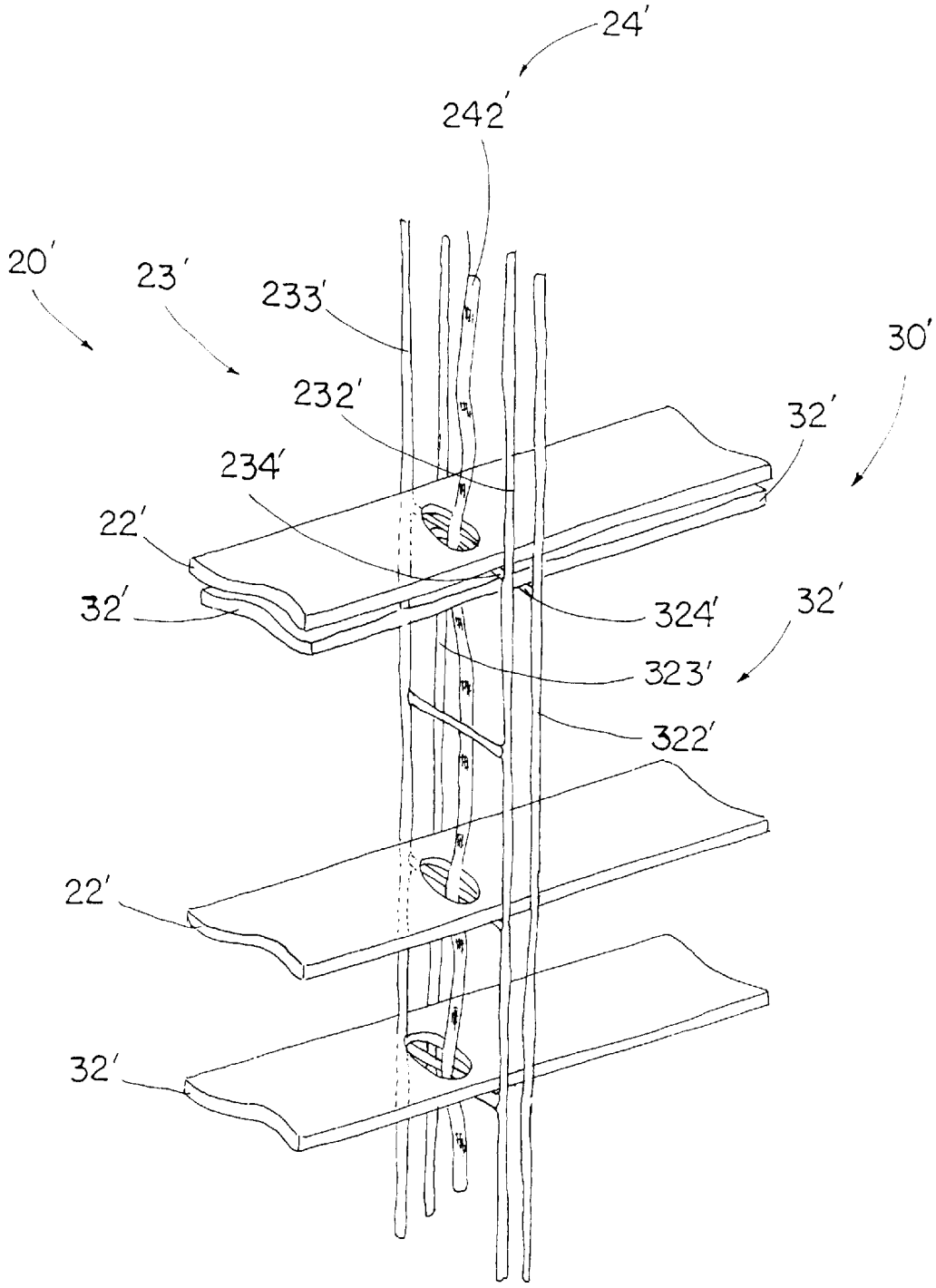
FIG. 6 is a partially perspective view of a window blinding system according to a second preferred embodiment of the present invention.

Referring to FIG. 6, a second embodiment of the window blinding system illustrates an alternative mode of the first preferred embodiment of the present invention, wherein the structure of the first shading arrangement 20' in the second embodiment is exactly the same as the first shading arrangement 20 in the first embodiment. The difference between the first and second embodiment is that the second shading arrangement 30' is arranged to selectively lift up a predetermined number of the second slats 32', so as to sectional open the space for the light pass through.

According to the second embodiment, the second slats 32' of the second shading arrangement 30' are suspendedly supported by the traverse cords 234 of the first blind supporting system 23 at the gap levels 222 respectively in such a manner that the first and second 22, 32' are evenly and suspendedly supported between the top traverse supporter 10 and the first base member 21 (31').

The second blind supporting system 33' also comprises the blind lock 331', two pairs of first and second supporting strings 332', 333' each having an lower end extended to the first bottom member 21(31'), and a plurality of traverse braces 334' spacedly extended between the first and second supporting strings 332', 333' for the second slats 32' rested on the traverse braces 334' respectively. Each pair of the first and second supporting strings 332', 333' upwardly extends to a front and back side of the second slats 32' and then traversely extends through the top traverse supporter 10, wherein free end portions of the first and second supporting strings 332', 333' are extended out of the top traverse supporter 10' via the blind lock 331' to control the vertical displacement of the second slats 32'. In other words, the first and second slats 22', 32' are positioned between the first and second supporting strings 332', 333'.

Figure 7:
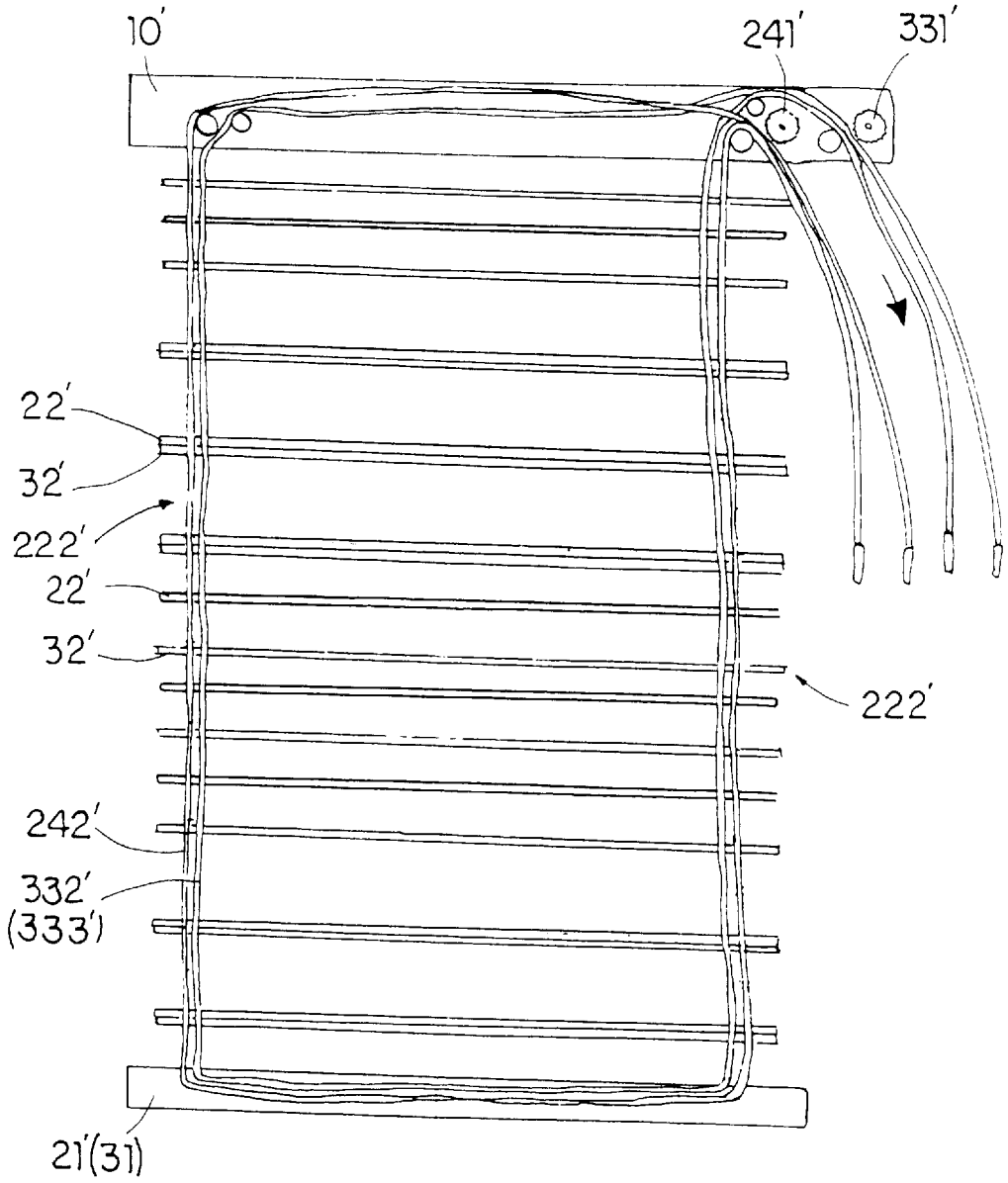
FIG. 7 is a schematic view of the window blinding system according to the above second preferred embodiment of the present invention.

The traverse braces 334' are selectively extended between the first and second supporting strings 332', 333' to support the second slats 32' in such a manner that when a pulling force is applied on the free end portions of the first and second supporting strings 332', 333', the second slats 33' which are supported by the traverse braces 334' respectively are lifted upwardly to overlappedly support underneath the first slats 22 respectively, as shown in FIG. 7. Therefore, the user is able to partially lift up the second slats 32' to provide more space between the first and second slats 22', 32' for allowing the light passing through. It is worth to mention that the second slats 32' are supported by the traverse cords 234' of the first blind supporting system 23' and the slats 32' which are selected to be lifted up are supported by the traverse braces 334' of the second blind supporting system 33'.

Figure 8:
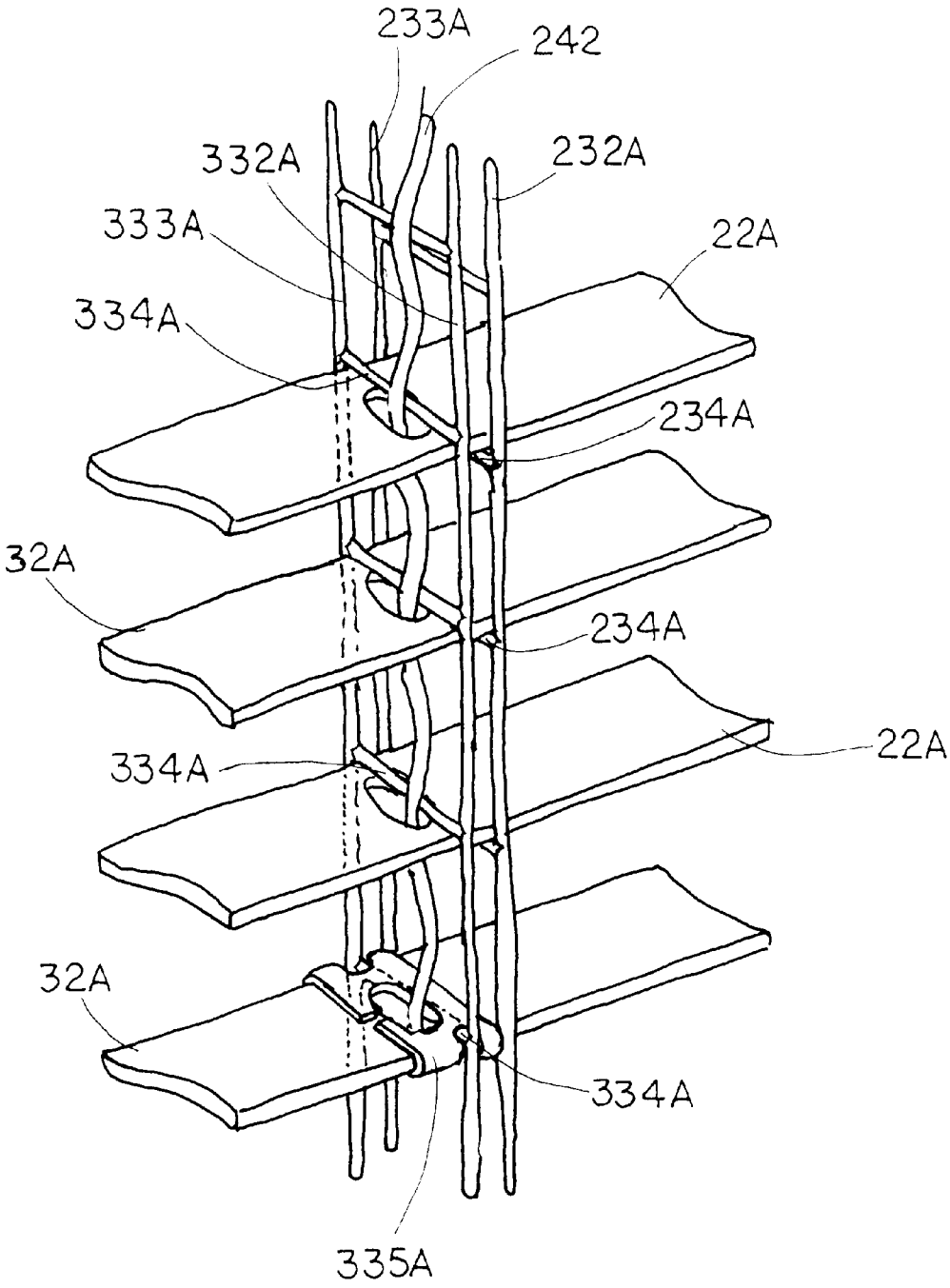
FIG. 8 illustrates an alternative mode of the window blinding system according to the above second preferred embodiment of the present invention.

FIG. 8 illustrates an alternative mode of the window blinding system which allows the user to select which second slats 32A to be lifted up. The traverse braces 334A are positioned above the second slats 32A respectively. The second blind supporting system 33A further comprises a plurality of slat clips 335A detachably mounted on the second slats 32A so as to connect the traverse braces 334A on the second slats 32A between the first and second supporting strings 332A, 333A.

Figure 9:
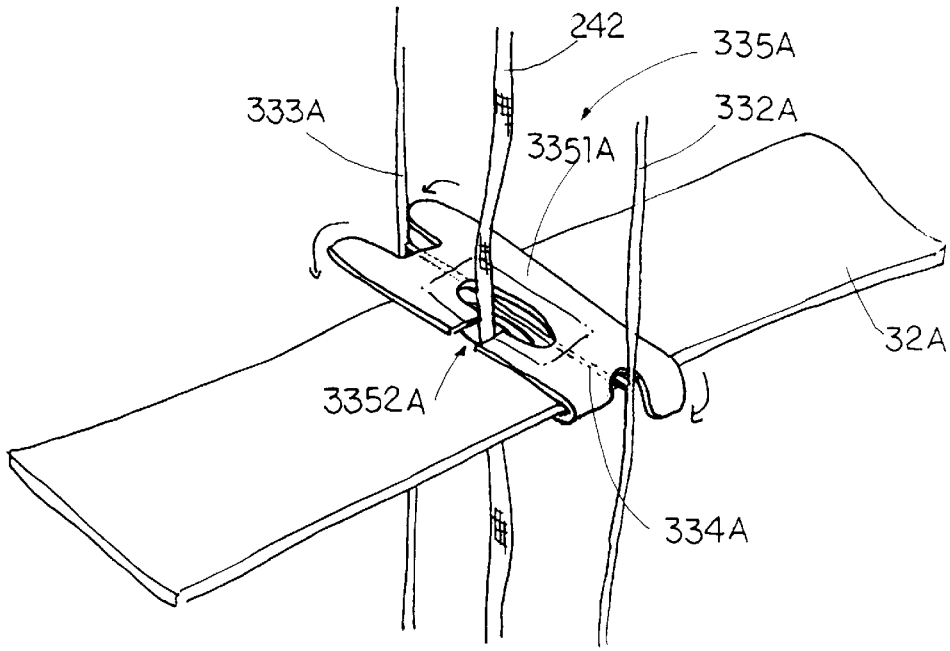
FIG. 9 is a perspective view of a slat clip of the window blinding system according to the alternative mode of the above second preferred embodiment of the present invention.

As shown in FIG. 9, each of the slat clips 335A comprises a main body 3351A having a length longer than a width of the second slat 32A and a guiding slot 3352A extended from a longitudinal side of the main body 3351A to a mid-portion thereof for the lift cord 242 passing through, wherein the main body 3351A is adapted to mount on the respective second slat 32A by folding two ends portion of the main body 3351A to a bottom surface of the second slat 32A overlappedly so as to sandwich the traverse brace 334A between the main body 3351A and the second slats 32A. In other words, the user is able to select which second slat 32A to be lifted up by mounting the slat clip 335A thereon.

Figure 10:
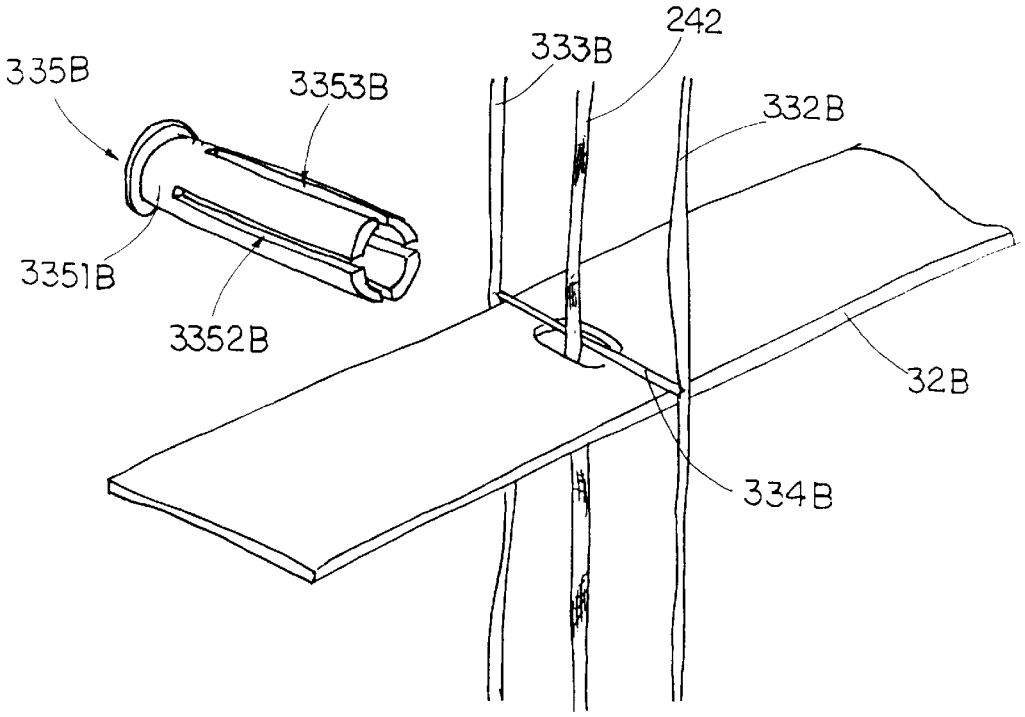
FIG. 10 illustrates an alternative mode of the slat clip of the window blinding system according to the above second preferred embodiment of the present invention.

FIG. 10 illustrates an alternative mode of the slat clip 335B of the second blind supporting system 33B which comprises a tubular main body 3351B having a first end, a first and a second guiding grooves 3352B, 3353B, which are perpendicular to each other, traversely extended from the first end of the main body 3351B respectively, wherein the first guiding groove 3352B has a width adapted for the second slat 32B sliding therein, and the second guiding groove 3353B has a width adapted for the first and second supporting strings 332B, 333B sliding therein, in such a manner that the second slat 32A is adapted to mount between the first and second supporting strings 332B, 333B by the slat clip 335B.

It is worth to mention that the traverse braces 334B may not required in the second blind supporting system 33B since the slat clip 335B can substantially support the second slat 32B between the first and second supporting strings 332B, 333B.

Figure 11:
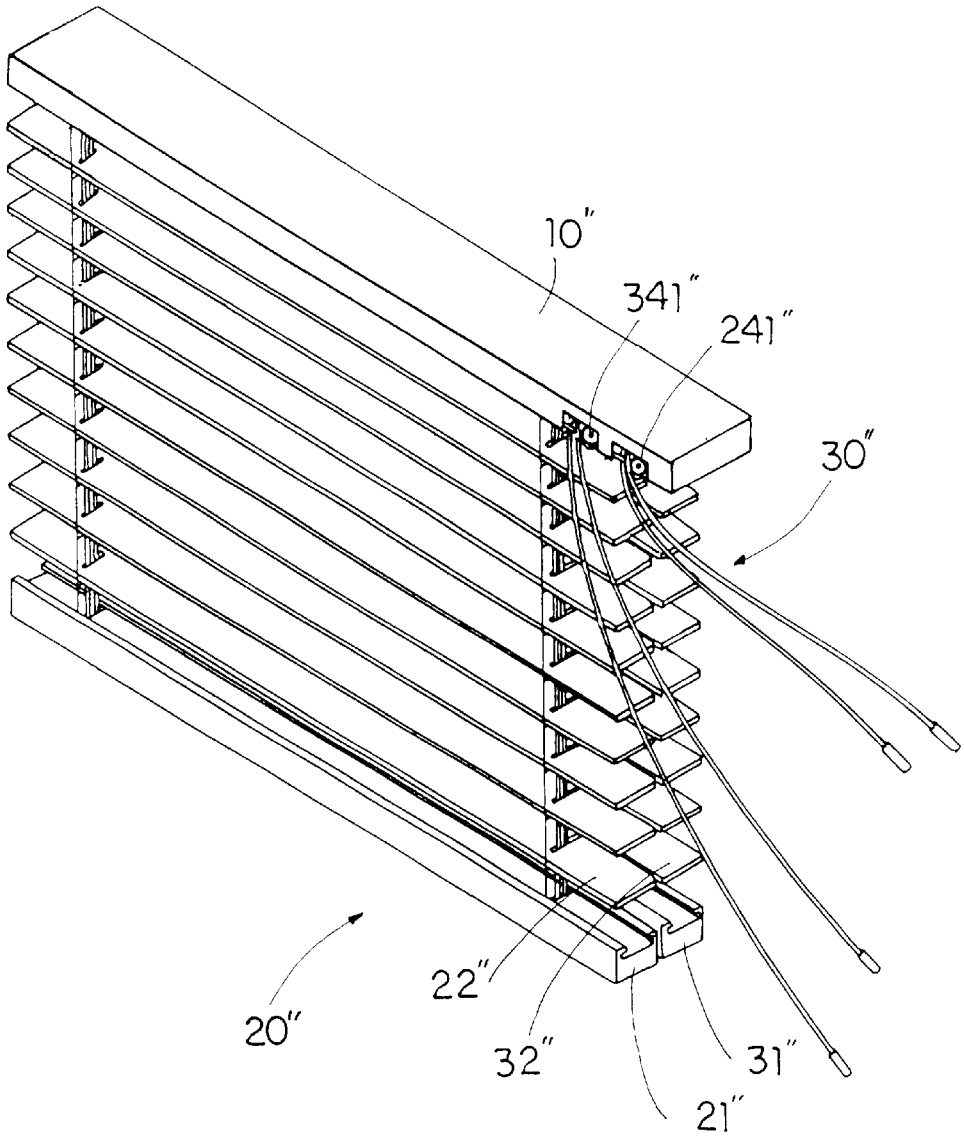
FIG. 11 is a perspective view of a window blinding system according to a third preferred embodiment of the present invention.

Referring to FIG. 11, a third embodiment of the window blinding system illustrates another alternative mode of the first embodiment, wherein the first and second shading arrangements 20", 30" are parallel with each other and downwardly extended from the top traverse supporter 10".

According to the third embodiment, the first arrangement 20" has the same structure of the first arrangement 20 of the first embodiment, such as the first base member 21", the first slats 22", the first blind supporting system 23" comprising the traverse arm 231", two pairs of the first and second supporting cords 232", 233" and the traverse cords 234", and the first operation system 24" comprising the lift lock 241", two lift cords 242".

The second shading arrangement 30" has the same structure of the first shading arrangement 20", which comprises the second base member 31", the second slats 32", the second blind supporting system 33" comprising the second traverse arm 331", two pairs of the first and second supporting strings 332", 333" and the traverse braces 334", and the second operation system 34" comprising the lift lock 341", two lift cords 342". In other words, the window blinding system 1" of the third embodiment comprises a pair of shading arrangements 20", 30" in a parallel manner.

Figure 12:
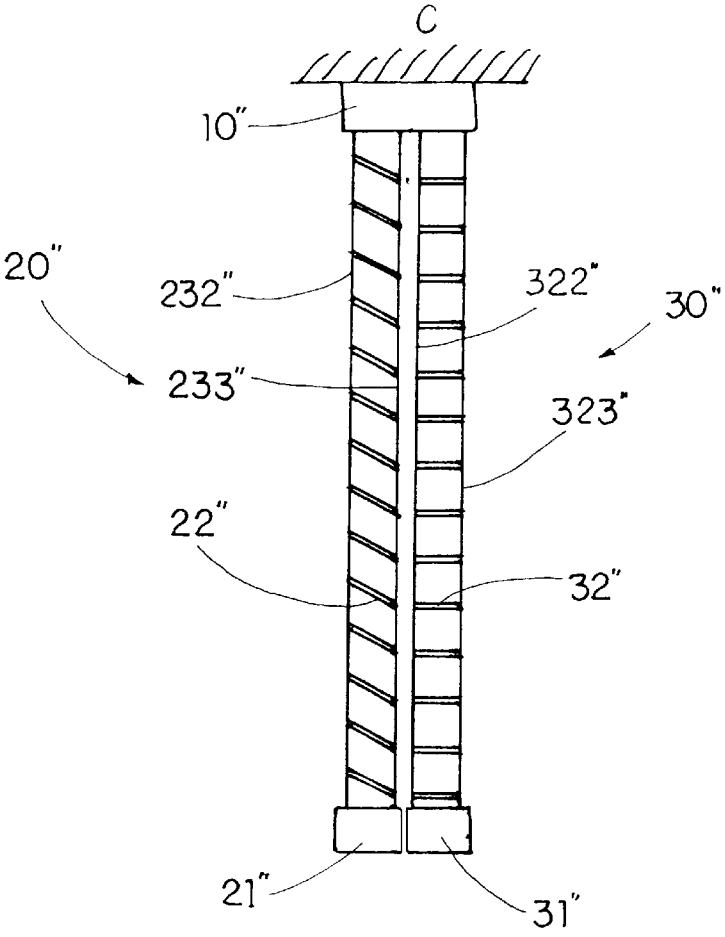
FIG. 12 is a schematic view of the window blinding system according to the above third preferred embodiment of the present invention.
Figure 13B:
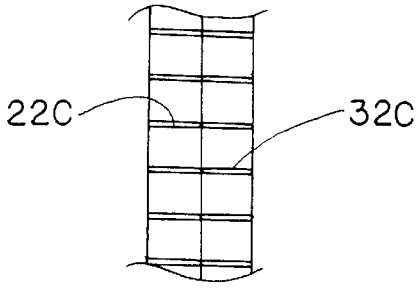
Figure 13C:
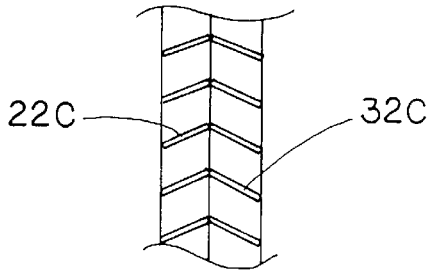
Figure 13D:
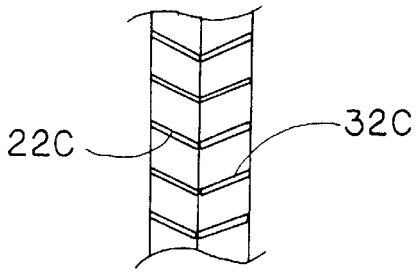
Figure 13E:
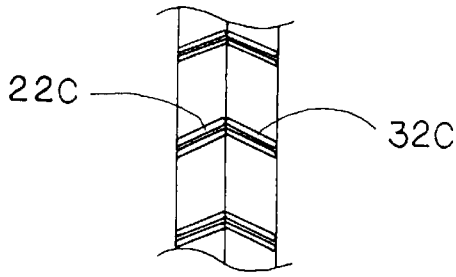
Figure 13F:
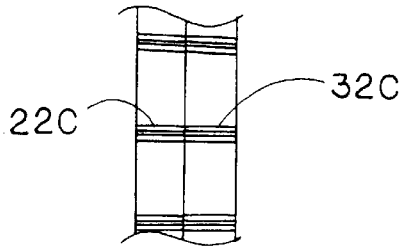
Figure 13G:
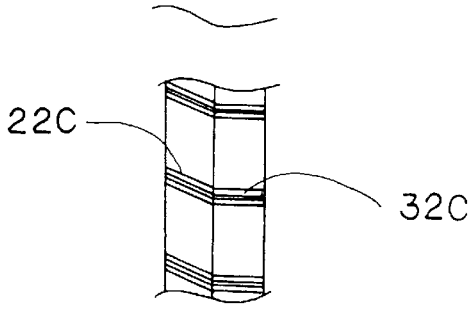
Figure 13H:
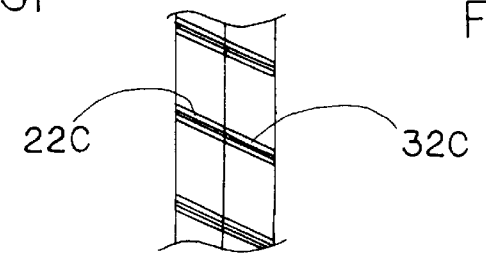

Therefore, the user is able to selectively operate one of the shading arrangements 20", 30" for controlling the tilt angle of the first and second slats 22", 32", so as to provide a multiple shading effects, as shown in FIG. 12.

Figure 13A:
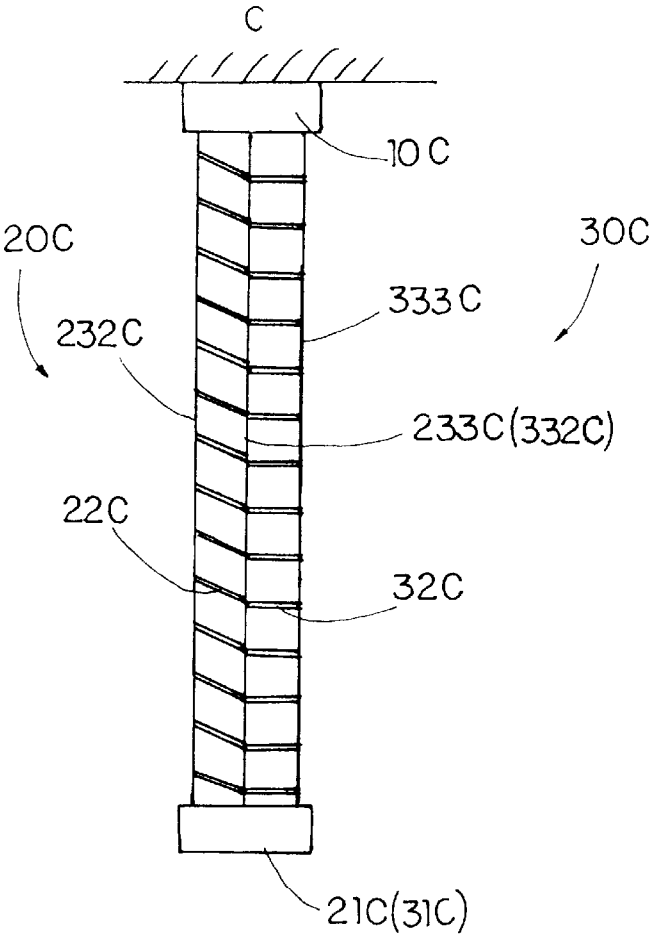
FIGS. 13A through 13H illustrate an alternative mode of the window blinding system according to the above third preferred embodiment of the present invention.

FIGS. 13A through 3H illustrate a n alternative mode of the window blinding system according to the third preferred embodiment of the present invention, wherein the first and second shading arrangements 20C, 30C are connected together in a parallel manner.

As shown in FIG. 13A, the second supporting string 333C of the second blind supporting system 33C is the first supporting cord 233C of the first blind supporting system 23C. In other words, the first supporting cord 233C is shared by the first and second blind supporting systems 23C, 33C to support the first and second slats 22C, 32C.

Furthermore, the first and second base members 21C, 31C are integrally connected together such that each of the first end portion of the lift cord 242C of the first operating system 24C further upwardly extends back to the top traverse supporter 10C by penetrating through the second slats 32C to form the second operating system 34C in such a manner that the first operation system 24C is adapted to lift and unlift the first and second shading arrangements 20C, 30C at the same time.

As shown in FIGS. 3A to 3D, by simply operating the first and the second shading arrangements 20", 30" individually, the first slats 22C and the second slats 32C will be controlled with different tilt angles to provide different shading effects.

It is worth to mention that the first and the second shading arrangements 20", 30" of the third embodiment can be incorporated with the operational structure of the first embodiment, as shown in FIGS. 3A and 3B, such that the first and second shading arrangements 20", 30" can be partially opened and partially closed so as to enhance the shading effects, as shown in FIGS. 3E to 3H.

What is claimed is:

1. A window blind system, comprising:

a top traverse supporter;

a first shading arrangement downwardly extended from said top traverse supporter and comprising a first base member, a plurality of first slats, a first blind supporting system for spacedly supporting said first slats horizontally between said top traverse supporter and said first base member and controlling a tilt angle of each of said first slats, and a first operating system for selectively lifting up said first base member towards said top traverse supporter and lowering said first base member to drop downwardly away from said top traverse supporter;

wherein said first blind supporting system comprises a traverse arm rotatably mounted on said top traverse supporter, two pairs of first and second supporting cords extended from two ends of said traverse arm to said first bottom member wherein said first slats are positioned between said first and second supporting cords, and a plurality of traverse cords spacedly extended between said first and second supporting cords for said first slats to rest on said traverse cords respectively;

wherein said first operating system comprises a lift lock rotatably mounted on said top traverse supporter and a pair of lift cords each having a first end portion extended to said first bottom member, each of said two lift cords upwardly extending to penetrate through said first slats and then traversely extending through said top traverse supporter, wherein a second end portion of each of said lift cords is extended out of said top traverse supporter via said lift lock to control a rotation of said first shading arrangement;

a second shading arrangement comprising a second base member, a plurality of second slats, and a second blind supporting system for spacedly supporting said second slats horizontally between said top traverse supporter and said second base member, and a second operation system for selectively lifting up said second base member towards said top traverse supporter and lowering said second base member to drop downwardly away from said top traverse supporter; and wherein said second blind supporting system is arranged to spacedly support said second slats horizontally between every two of said first slats and comprises a blind lock rotatably mounted on said top traverse supporter, two pairs of first and second supporting strings each having a lower end extended to said first bottom member, and a plurality of traverse braces spaced and extending between said first and second supporting strings for said second slats to rest on said traverse braces respectively, wherein said pairs of first and second supporting strings of said second blind supporting system are extended adjacent to said pairs of first and second supporting cords of said first blind supporting system in a side by side manner, each pair of said first and second supporting strings upwardly extends to two opposed sides of said first and second slats and then traversely extends through said top traverse supporter, wherein free end portions of said first and second supporting strings are extended out of said top traverse supporter via said blind lock to control a vertical displacement of each of said second slats, wherein each of said lift cords also upwardly extends to penetrate through said second slats to form said second operation system in such a manner that said first operation system is adapted to selectively lift and lower said first and second shading arrangements at the same time, wherein each of said second slats is horizontally suspended at a gap level defined at a middle of every two of said first slats wherein said gap level is formed by said traverse cord of said first blind supporting system such that a distance between every two of said first slats is double a height of said gap level.

2. A window blind system, as recited in claim 1, further comprising a third shading arrangement which comprises a plurality of third slats and a third blind supporting system arranged to spacedly supporting said third slats horizontally between said first and second slats and comprising a second blind lock rotatably mounted on said top traverse supporter, two pairs of first and second supporting ropes each having a lower end extended to said first bottom member, and a plurality of traverse ropes spaced and extending between said first and second supporting ropes for said third slats to rest on said traverse ropes respectively, each pair of said first and second supporting ropes upwardly extends to two opposed sides of said first, second, and third slats and then traversely extends through said top traverse supporter, wherein free end portions of said first and second supporting ropes are extended out of said top traverse supporter via said second blind lock to control a vertical displacement of each of said third slats.

3. A window blind system, as recited in claim 2, wherein each of said lift cords also upwardly extends to penetrate through said third slats in such a manner that said first operation system is adapted to selectively lift and lower said first, second, and third shading arrangements at the same time.

4. A window blind system, as recited in claim 3, wherein every two of said first slats defines two gap levels where said second and third slats positioned thereat respectively, wherein a vertical distance of each gap level is one-third of a distance between each two first slats.

5. A window blind system, as recited in claim 1, wherein said traverse braces are selectively extended between said first and second supporting strings to support said second slats in such a manner that said second slats which are supported by said traverse braces respectively are lifted upwardly to overlap and support underneath said first slats respectively when a pulling force is applied on said free end portion of said first and second supporting strings.

6. A window blind system, as recited in claim 5, wherein said second blind supporting system further comprises at least a slat clip detachably mounted on said second slats, wherein said slat clip comprises a main body having a length longer than a width of said second slat and a guiding slot extended from a longitudinal side of said main body to a mid-portion thereof for said lift cord passing through, wherein said main body is adapted to mount on said second slat by folding two ends portion of said main body to a bottom surface of said second slat overlappedly so as to sandwich said traverse brace between said main body and said second slats.

7. A window blind system, as recited in claim 5, wherein said second blind supporting system further comprises at least a slat clip detachably mounted on said second slats, wherein said slat clip comprises a tubular main body having a first end, a first and a second guiding grooves, which are perpendicular to each other, traversely extended from said first end of said main body respectively, wherein said first guiding groove has a width adapted for said second slat sliding therein, and said second guiding groove has a width adapted for said first and second supporting strings sliding therein, in such a manner that said second slat is adapted to mount between said first and second supporting strings by said slat clip slidably mounting on said second slat.

* * * * *